US005161782A

United States Patent [19]

Huang

[11] Patent Number: 5,161,782

[45] Date of Patent: Nov. 10, 1992

[54] MECHANICAL JACK

[75] Inventor: Chen S. Huang, Hsin-Chung, Taiwan

[73] Assignee: You Jin Industrial Co., Ltd., Taipei Hsien, Taiwan

[21] Appl. No.: 811,015

[22] Filed: Dec. 20, 1991

[51] Int. Cl.[5] ..... B66F 33/00

[52] U.S. Cl. ..... 254/126; 254/8 B

[58] Field of Search ..... 254/1, 100, 101, 124, 254/126, 7 R, 7 B, 8 R, 8 B, 8 C

[56] References Cited

U.S. PATENT DOCUMENTS

| | | | |
|---|---|---|---|
| Re. 30,640 | 6/1981 | Keilholz | 254/126 |
| 2,183,427 | 12/1939 | Hou | 254/126 |
| 3,693,937 | 9/1972 | Yamazaki | 254/126 |
| 4,919,392 | 4/1990 | Minuto | 254/126 |
| 5,033,717 | 7/1991 | Symon | 254/124 |

*Primary Examiner*—J. J. Swann

[57] ABSTRACT

A mechanical jack comprising a base, on which a fixed frame is fixed. The fixed frame is substantially up-standing, slightly inclining toward one side with a supporting frame attached thereon to maintain the fixed frame in its inclined position. A moveable frame with one end thereof pivotally attached on the fixed frame is rotatable with respect to the fixed frame about the pivot. A threaded rod, which has a threaded portion engaging with an inner-threaded block pivotally mounted on the other end of the moveable frame by means of a replaceable bearing element and a smooth portion running through and secured on a pivot mounted on the fixed frame, retracts and extends, when rotated about the central axis thereof, the moveable frame with respect to the fixed frame so that heighten and lower a vehicle support attached on the moveable frame.

9 Claims, 2 Drawing Sheets

MECHANICAL JACK

FIELD OF THE INVENTION

The invention relates generally to a jack and in particular to a portable, substantially up-standing screw-type jack for vehicle maintenance which can be operated by hands or by other power systems.

BACKGROUND OF THE INVENTION

Conventionally, jacks for vehicle maintenance in garages are hydraulic type which provide high output and efficiency. These jacks usually require some expensive high precision hydraulic elements and thus need careful maintenance. Besides, these jacks are bulky and not fit for vehicle-carrying purpose. For those jacks of vehicle-carrying purpose, some are hydraulic types and some are electrical motor driving types. Both comprise complicated and sometimes sophisticated elements and thus expensive.

Furthermore, the operation of a conventional screw type jack requires an operator an operating device to move forward or backward with the forward or backward rotation of the screw. This sometimes resulting in an unstable operation of the jack.

OBJECTS OF THE INVENTION

It is therefore an object of the present invention to provide a mechanical jack which has simple construction and thus cheap.

It is a further object of the present invention to provide a mechanical jack which comprises no sophisticated elements and thus needs almost no maintenance.

It is a further object of the present invention to provide a mechanical jack which comprises replaceable bearing elements to support the pivoting action of parts so that when the replaceable bearing elements are worn out, substitutes thereof can be installed in the jack and thus reduce the cost of substituting the whole jack with a new one.

It is a further object of the present invention to provide a mechanical jack of which the operator to the operating device, such as a motor, need not to move with the forward or backward rotation of the screw.

To achieve the above-mentioned objects, there is provided a mechanical jack comprising a base, on which a fixed frame is fixed. The fixed frame is substantially up-standing, slightly inclining toward one side with a supporting frame attached thereon to maintain the fixed frame in its inclined position. A moveable frame with one end thereof pivotally attached on the fixed frame is rotatable with respect to the fixed frame about the pivot. A threaded rod, which has a threaded portion engaging with an inner-threaded block pivotally mounted on the other end of the moveable frame by means of a replaceable bearing element and a smooth portion running through and secured on a pivot mounted on the fixed frame, retracts and extends, when rotated about the central axis thereof, the moveable frame with respect to the fixed frame so that it heightens and lowers a vehicle support attached on the moveable frame.

Other objects and advantages of the invention will be apparent from the following description of the preferred embodiment taken in connection with the accompanying drawing wherein:

DETAILED DESCRIPTION OF THE PREFERRED EMBODIMENT

Figure 1:
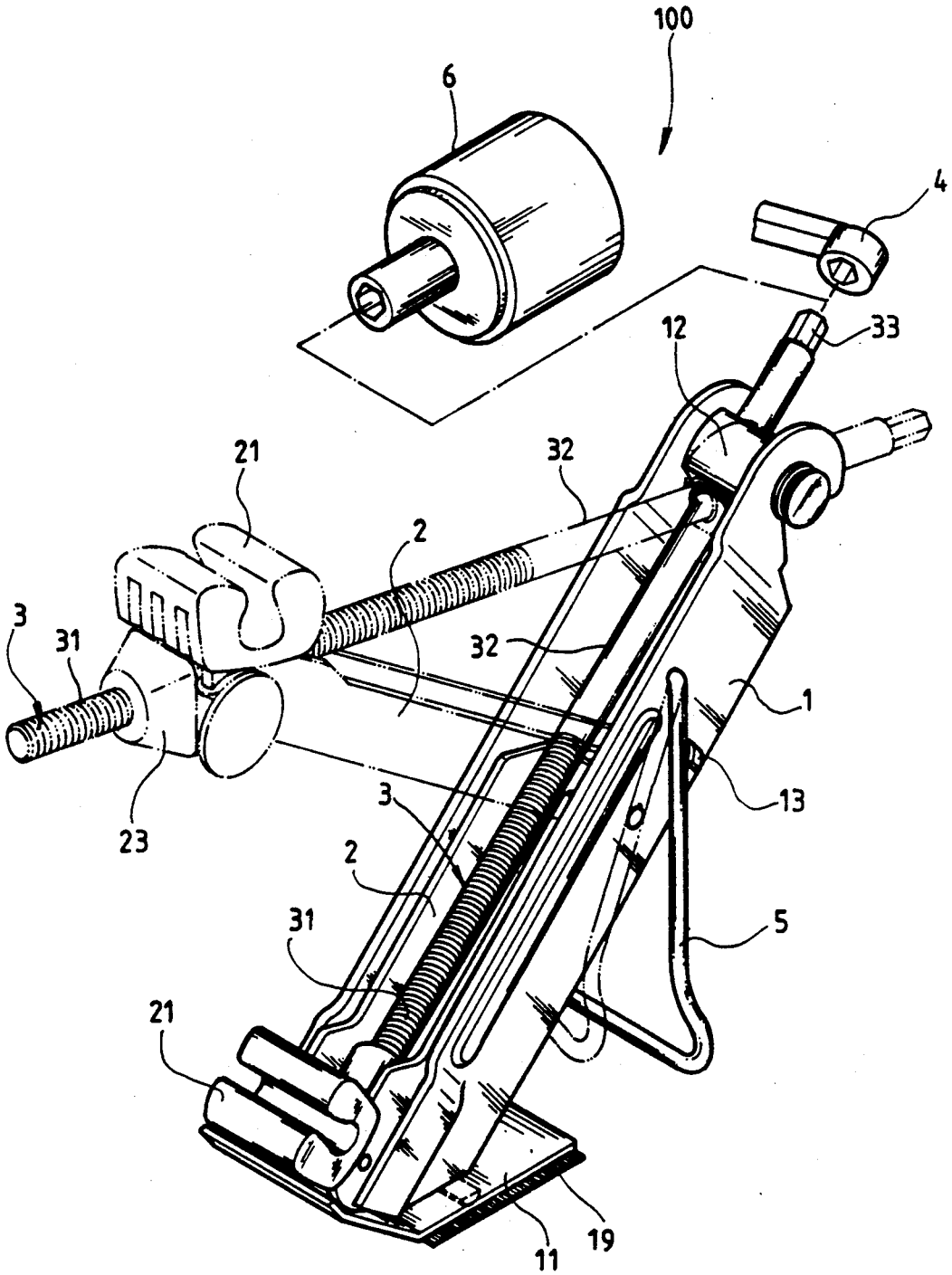
FIG. 1 is a perspective view of a mechanical jack in accordance with the present invention.

With reference to the drawing and in particular to FIG. 1, a mechanical jack in accordance with the present invention, generally designated with the reference numeral 100, comprises a base 11 on which an inclined fixed frame 1 is secured with a lower end thereof, a moveable frame 2 which has a pivotal end pivotally attached to the fixed frame 1 and a free end rotatable with respect to the fixed frame 1 about the pivotal end thereof, a threaded rod 3 which has a threaded portion 31 engaging with an inner-threaded block 23 (to be described hereinafter) rotatably mounted on the free end of the moveable frame 2 and a smooth portion 32 secured on a pivotal pin 12 rotatably mounted on the fixed frame 1. The smooth portion 32 of the threaded rod 3 is so secured on the pivot pin 12 that the threaded rod 3 is rotatable about a central axis thereof but not slidable with respect to the pivot pin 12 and the threaded rod 3 is rotatable with respect to the fixed frame 1 about the pivotal pin 12. An adaptor 33 is formed on the outer end of the smooth portion 32 to engage with a socket 4 to be operated manually or a power driving system 6. The base 11 is shown in the form of a plate, it is however not necessary in carrying out the present invention. To provide a more stable support to a vehicle (not shown), preferably, an anti-sliding pad 19 is secured on the underside of the base plate 11 (namely, the side opposite to the side on which the fixed frame is secured). A suitable material for such an anti-sliding pad is for example a rubber pad. Other materials which can provide a great friction with usual ground surface are workable as such a pad.

The mechanical jack 100 further comprises a supporting frame 5 which is pivotally attached to the fixed frame so as to support the fixed frame on its inclined position. The supporting frame 5 may be in the form of a U shape with the two limbs thereof pivotally attached to the fixed frame 1 and the bottom thereof serving as the abutting member to the ground. The supporting frame 5 is rotatable from a closed position (the phantom line of FIG. 1) where the supporting frame 5 is close to the fixed frame 1 to an open position (the solid line id FIG. 1) where the supporting frame 5 forms, together with the fixed frame 1, an included angle therebetween so as to be able to maintain the position of the fixed frame 1. A stop 13 is provided on the fixed frame 1 to ensure the supporting frame 5 is always on the right position (the open position) to support the fixed frame 1. The number of stops 13 may not necessarily be one, the may be more than one stop.

Figure 2:
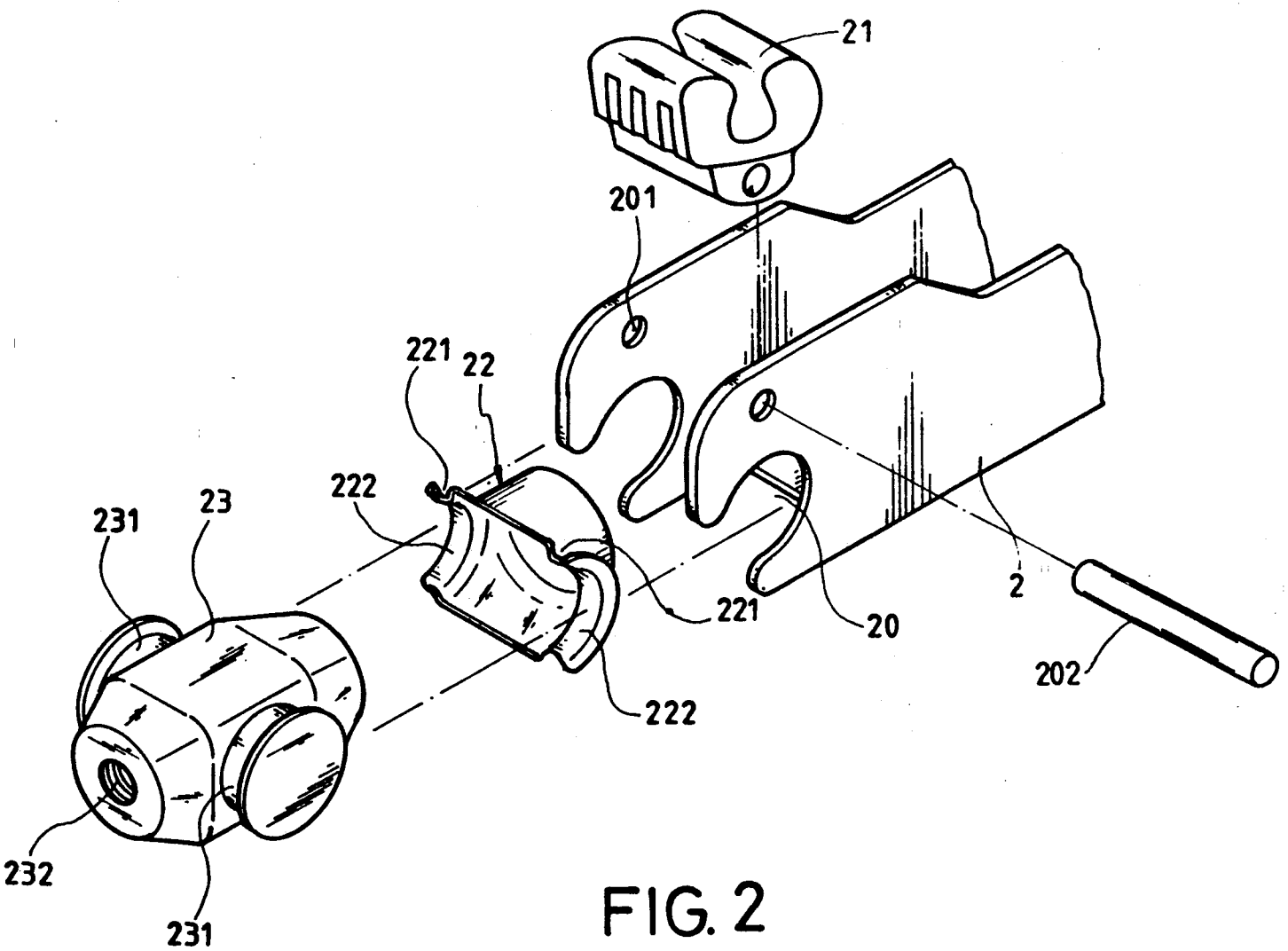
FIG. 2 is an exploded perspective view of parts of the mechanical jack shown in FIG. 1 showing the construction of the replaceable bearing element.

Further referring to FIG. 2, the inner-threaded block 23 has a threaded hole 232 running therethrough to engageably receive therein the threaded portion 31 of the threaded rod 3. A pair of protrusions 231 in the form of a short cylinder with a radial circumferential flange thereon to serve as a retainer are attached on the inner-threaded block 23. A replaceable bearing element 22 which is of a complementary shape to the inner-threaded block 23 is tightly fit on the inner-threaded block 23 and tightly secured thereon with the frictional force therebetween. Since the bearing element 22 is complementary in shape to the inner-threaded block 23, it has a pair of semi-circular notches 222 to fit to the protrusions 231 of the inner-threaded block 23. The semi-circular notches 222 have a backside configuration 221, which is essentially semi-circular, suitable to rotatably fit into openings 20 formed on the free end of the moveable frame 2. With the bearing element 22 so mounted on the free end of the moveable frame 2, the inner-threaded block 23 is pivotally attached to the free end of the moveable frame 2 and thus rotatable with respect to the moveable frame 2 about an axis running through the center of the short cylinders 231 of the inner-threaded block 23 and that of the notches 222 of the bearing element 22 and that of the openings 20 of the free end of the moveable frame 2.

A vehicle support 21 is also mounted on the free end of the moveable frame 2. The free end of the moveable frame 2 may has a plurality of holes 201 to receive therein securing means, such as a pin 202, for rotatably securing the vehicle support 21 thereon.

Due to the pivotal connections between the fixed frame 1 and the moveable frame 2, between the fixed frame 1 and the pivotal pin 12, and between the moveable frame 2 and the inner-threaded block 23, and further due to the threading engagement between the threaded rod 3 and the inner-threaded block 23, when the threaded rod 3 is rotated about its central axis, the movable frame 2 is rotated about the pivoting end thereof and the vehicle support 21 mounted on the free end of the moveable frame 2 is either heightened or lowered. This accomplishes the lifting action of the mechanical jack 100 of the present invention.

The dimensions of the fixed frame 1, the moveable frame 2 and the threaded rod 3 are such that the moveable frame 2 is moveable from a retracted position (solid line of FIG. 1) where the moveable frame 2 and the threaded rod 3 are close to the fixed frame 1 and the space occupied by the whole jack 100 is less to an expanded position (phantom line of FIG. 1) where the free end of the moveable frame 2 is moved to the highest position with respect to the base 11 and a vehicle (not shown) can thus be lifted to the highest position.

It is apparent that although the invention has been described in connection with the preferred embodiment, it is contemplated that those skilled in the art may make changes to certain features of the preferred embodiment without altering the overall basic function and concept of the invention and without departing from the spirit and scope of the invention as defined in the appended claims.

What is claimed is:

1. A mechanical jack comprising:

a base having an upper side and an underside disposed on a supporting surface;

a fixed frame having a first end fixed on the upper side of the base to form an inclined angle with respect to an imaginary line generally normal to the base and a second end which is at a position higher than the first end thereof;

a movable frame having a first end pivotally mounted on the fixed frame and a second end which is free to rotate about the first end thereof so as to move the moveable frame along a first direction from a retracted position where the moveable frame is close to the fixed frame and the free end of the moveable frame is in a lowermost position to an expanded position where the free end of the moveable frame is in a highermost position or to move the moveable frame along a second direction from the expanded position to the retracted position;

a threaded rod having a threaded portion in threading engagement with an inner-threaded block which is pivotally mounted on the free end of the movable frame and a smooth portion which is so secured on a pivot disposed on the second end of the fixed frame that the threaded rod is rotatable with respect to a central axis thereof while not slidable with respect to the pivot, said inner-threaded block having a pair of protrusions in the form of a short cylinder with a radial circumferential flange serving as a retainer attached thereon;

a removable and replaceable bearing element which is complementary in shape to the inner-threaded block so as to be tightly fitted thereon and secured thereon by means of the frictional force therebetween, said bearing element having notches corresponding to the short cylinders of the inner-threaded block and being tightly fitted thereon, said bearing element having backside configurations respectively opposite to said notches which are respectively received in openings formed on the free end of the moveable frame so that the inner-threaded block is rotatable with respect to the free end of the moveable frame about an axis running through the short cylinders; and an adaptor formed on an outer end of the smooth portion of the threaded rod to engage with a driving means;

whereby, when the threaded rod is rotated in a first direction about the central axis thereof with the adaptor, the moveable frame is moved along the first direction thereof through the inner-threaded block to heighten the free end of the moveable frame, and when the threaded rod is rotated in a second direction, the moveable frame is moved along the second direction thereof to lower the free end thereof.

2. A mechanical jack as claimed in claim 1, further comprising a vehicle support on which a vehicle may rest, the vehicle support being attached on the free end of the moveable frame so that when the free end of the moveable frame is in the highest position, the vehicle resting on the vehicle support is also in the highest position.

3. A mechanical jack as claimed in claim 2, wherein the vehicle support is slightly rotatable with respect to the free end of the moveable frame so as to be adaptive to the movement of the moveable frame while without losing contact with the vehicle resting thereon.

4. A mechanical jack as claimed in claim 1 further comprising an anti-sliding pad secured on the underside of the base, which is made of a material having a great friction with the supporting surface.

5. A mechanical jack as claimed in claim 4 wherein said material is rubber.

6. A mechanical jack as claimed in claim 1 further comprising a supporting frame which is pivotally connected to the fixed frame so as to be rotatable with respect to the fixed frame from a first position where the supporting frame is close to the fixed frame to a second position where the supporting frame forms, together with the fixed frame, an included angle therebetween so as to maintain the fixed frame in the inclined position.

7. A mechanical jack as claimed in claim 6 wherein the supporting frame is U-shaped, having two limbs pivotally attached to the fixed frame and a bottom to contact the supporting surface when the supporting frame is in the second position.

8. A mechanical jack as claimed in claim 1 wherein the driving mean is a socket with a wrench operated manually.

9. A mechanical jack as claimed in claim 1 wherein the driving mean is an electrically operated socket.

* * * * *